US008481896B2

(12) United States Patent
Quinton, Jr.

(10) Patent No.: US 8,481,896 B2
(45) Date of Patent: Jul. 9, 2013

(54) HEATER PLATE WITH EMBEDDED HYPER-CONDUCTIVE THERMAL DIFFUSION LAYER FOR INCREASED TEMPERATURE RATING AND UNIFORMITY

(76) Inventor: Phillip G. Quinton, Jr., Pleasanton, CA (US)

( * ) Notice: Subject to any disclaimer, the term of this patent is extended or adjusted under 35 U.S.C. 154(b) by 399 days.

(21) Appl. No.: 12/881,790

(22) Filed: Sep. 14, 2010

(65) Prior Publication Data

US 2011/0132896 A1 Jun. 9, 2011

Related U.S. Application Data

(60) Provisional application No. 61/267,769, filed on Dec. 8, 2009.

(51) Int. Cl.
*H05B 3/06* (2006.01)
*H05B 3/68* (2006.01)
*F28F 7/00* (2006.01)

(52) U.S. Cl.
USPC ..... 219/532; 219/443.1; 165/185

(58) Field of Classification Search
USPC ..... 219/532, 553, 552, 443.1, 444.1, 219/449.1, 451.1, 468.1, 521, 534, 538, 542, 219/544, 546–548, 465.1, 466.1; 165/185
See application file for complete search history.

(56) References Cited

U.S. PATENT DOCUMENTS

| | | | | |
|---|---|---|---|---|
| 4,481,406 | A | 11/1984 | Muka | |
| 4,742,324 | A * | 5/1988 | Shida et al. | 338/238 |
| 5,343,022 | A * | 8/1994 | Gilbert, Sr. et al. | 219/552 |
| 5,348,215 | A * | 9/1994 | Rafferty et al. | 228/181 |
| 5,863,467 | A | 1/1999 | Mariner et al. | |
| 6,147,334 | A * | 11/2000 | Hannigan | 219/444.1 |
| 6,534,751 | B2 | 3/2003 | Uchiyama et al. | |
| 6,758,263 | B2 | 7/2004 | Krassowski et al. | |
| 7,901,509 | B2 | 3/2011 | Mariner et al. | |
| 2009/0235866 | A1 | 9/2009 | Kataigi et al. | |

FOREIGN PATENT DOCUMENTS

WO WO 9609738 A1 * 3/1996

OTHER PUBLICATIONS

Accuratus Corporation, Boron Nitride, BN Material Properties, 2002.*

* cited by examiner

*Primary Examiner* — Sang Paik
*Assistant Examiner* — Renee L Miller
(74) *Attorney, Agent, or Firm* — Schneck & Schneck; Thomas Schneck; Mark Protsik

(57) ABSTRACT

A heater plate is constructed with an embedded thermal diffusion layer of pyrolytic graphite to provide increased temperature uniformity in a critical heating surface. The heater has first and second metal plates with a heater element contained within the first plate and a core of the pyrolytic graphite diffusion layer sandwiched between the heater element and the second metal plate. The diffusion layer may be sputter metal coated to improve bonding of the layer to the plates.

24 Claims, 2 Drawing Sheets

HEATER PLATE WITH EMBEDDED HYPER-CONDUCTIVE THERMAL DIFFUSION LAYER FOR INCREASED TEMPERATURE RATING AND UNIFORMITY

CROSS-REFERENCE WITH RELATED APPLICATION

This application claims priority from U.S. provisional application Ser. No. 61/267,769,filed Dec. 8, 2009.

TECHNICAL FIELD

The present invention relates to heater plates and in particular to structural details of such heater plates specifically adapted to provide uniform heating.

BACKGROUND ART

Achieving the most uniform temperature on the surface of a heater can be limited due to the thermal conductivity of the materials of construction. Often, material options are limited by factors such as temperature rating, chemical compatibility, or thermal expansion. Geometry of the heater can have a significant impact on asymmetric losses and aggravate thermal non-uniformity. Typically, experience and thermal modeling are used for the heater design for the most effective power distribution. Heat homogenizing ceramic materials may be used for the outer plates. Metallic heat spreaders, e.g., a copper core, may be used. But, even with the most effective heater layout and construction, the thermal uniformity may need still further improvement, as a typical heating plate at 250° C. may have a maximum-minimum range of as much as 15-20° C. Examples of prior heaters are provided in U.S. Pat. No. 4,481,406 (Muka), U.S. Pat. No. 6,534,751 (Uchiyama et al.), U.S. Pat. No. 6,758,263 (Krassowski et al.) and U.S. Patent Application Publication No. 2009/0235866 (Kataigi et al.).

SUMMARY DISCLOSURE

Integrating a thermally annealed pyrolytic graphite (TPG) layer, between the heater and the critical surface of the plate dramatically improves the thermal uniformity. TPG is sometimes referred to as "hyper conductive" due to its having a thermal conductivity about four times that of copper. The high, in-plane thermal conductivity coefficient k allows for only shallow gradients. Thus, the provision of TPG material within a heater plate will help to distribute the heat from an isolated embedded heater element so that the operating surface of the plate has a more uniform temperature.

In summary, the invention provides a uniform heater having a core formed of a thermally-annealed pyrolytic graphite (TPG) diffuser sandwiched between a first metal plate containing a heater element and a second metal plate providing a critical surface. The plates and TPG diffuser may be vacuum thermal brazed together. The TPG diffuser may have a molybdenum coating and nickel braze alloy sheets may be present between the diffuser and the respective plates.

DETAILED DESCRIPTION

Figure 1:
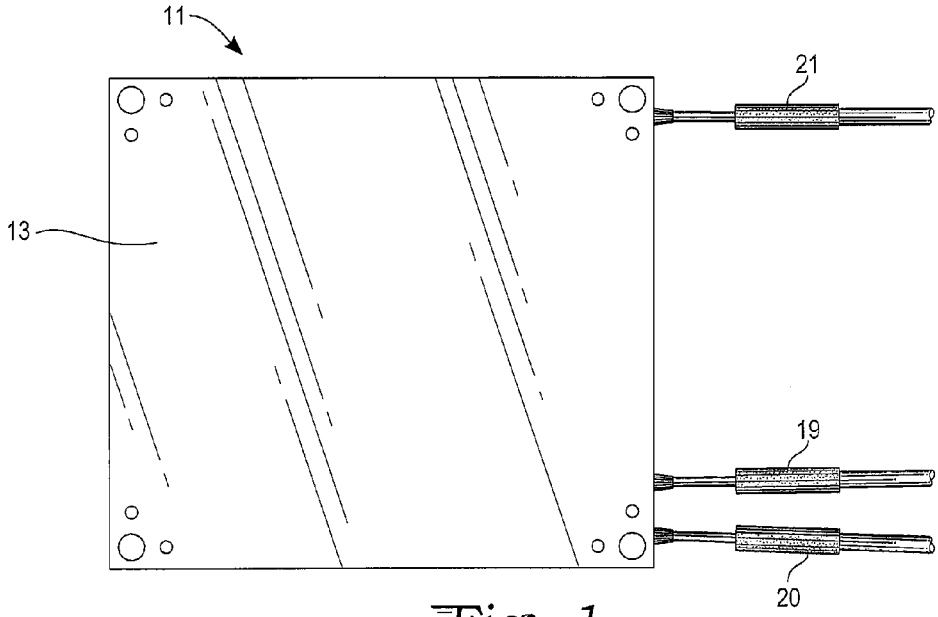
FIG. 1 is a top view of heater plate consistent with the present invention.

With reference to FIG. 1, a heater 11 has a critical heating surface on a thermally conductive upper plate 13. Two electrodes 19 and 21 for in internal heater coil are seen to emerge from a side of the heater 11, along with a ground electrode 20 for the plate 13.

Figure 2:
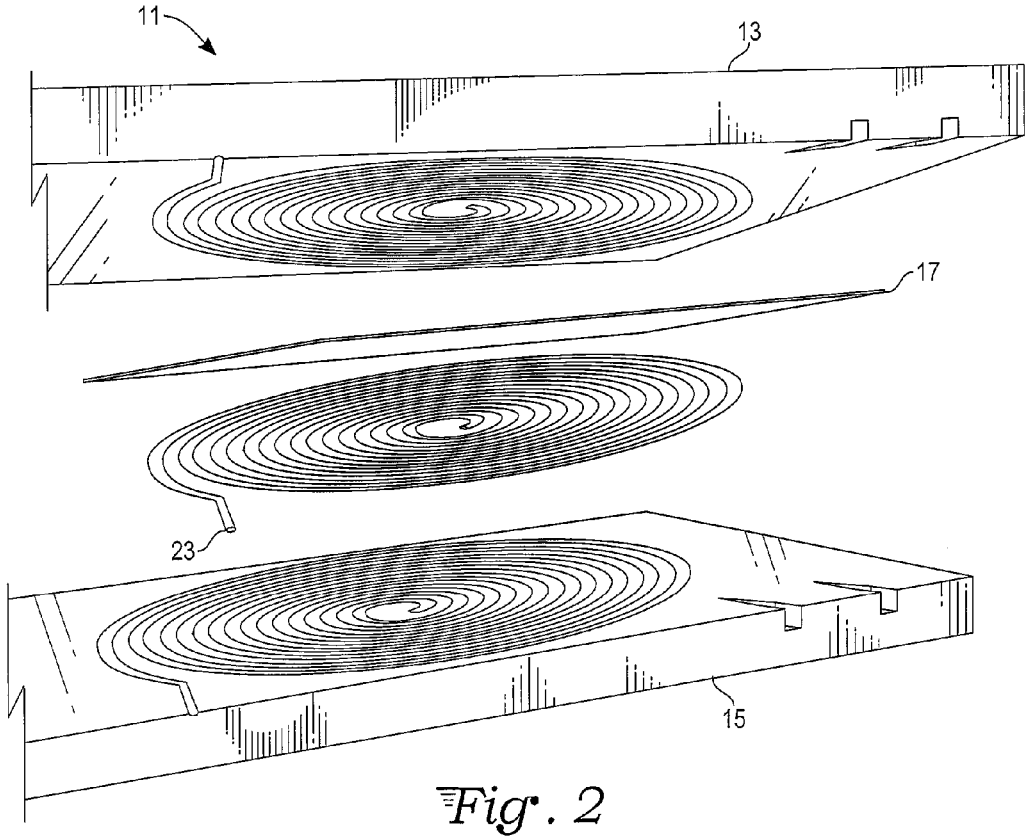
FIG. 2 is a side exploded view of an embodiment of a heater plate of the present invention.

As seen in FIG. 2, the heater 11 includes upper and lower plates 13 and 15, together with and a thermal pyrolytic graphite (TPG) diffusion layer 17 and an electrically isolated heating element 23 located between the two plates 13 and 15. An interface material, not shown, fills voids between the various component parts 13, 15, 17 and 21, and bonds the plates 13 and 15 together.

The upper and lower plates 13 and 15 may be made of metal. However, the plate material need not have especially high thermal conductivity in the plane of the plates because of the presence of the TPG diffusion layer 17 that serves to uniformly spread the heat from the heating element across the critical surface of the upper plate 13. Thus, the plate material can be selected from a variety of metals, including stainless steels and nickel alloys, titanium, magnesium, molybdenum, tungsten, copper, aluminum, and combinations or alloys of the same. (The stainless steels and nickel alloys are sold under a number of trade names, including AISI 304 and 316 stainless steels, Incoloy®, Iconel®, Hastelloy®, and Nickel 600 (UNS N06600). These metals and others can be used.)

Figure 3:
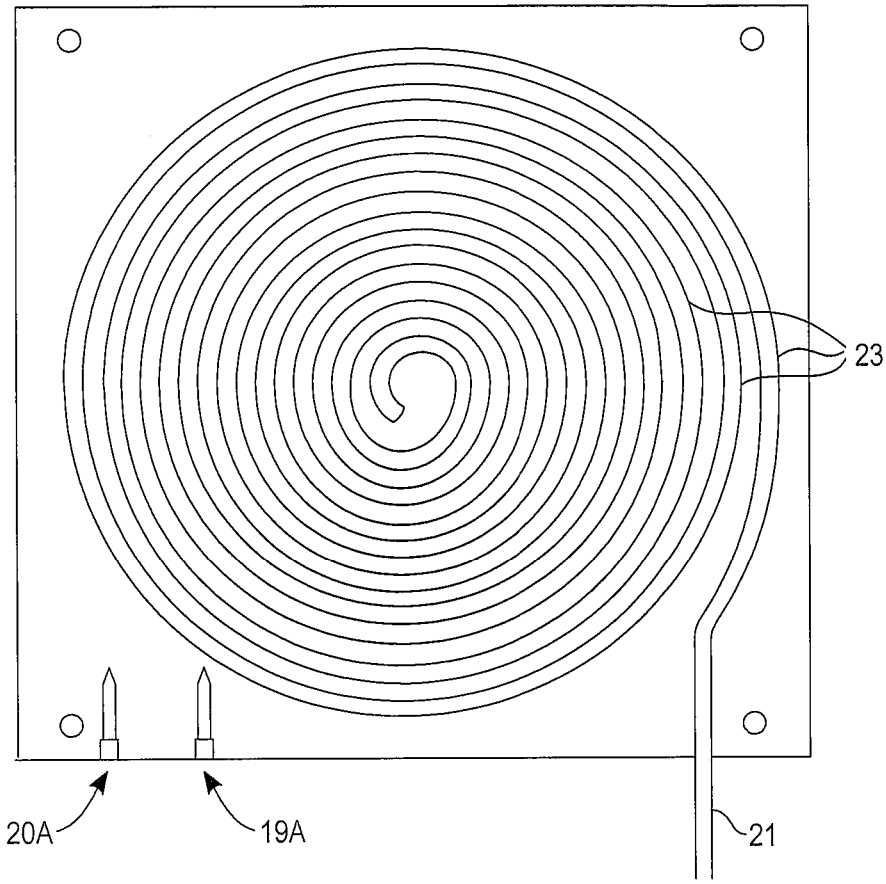
FIG. 3 is a top view of a lower heater plate accommodating a heater coil.

As seen in FIG. 3, the lower plate 15 may contain a spiral cavity to accept the heater element 23. Alternatively, the cavity for the heater element 23 could be simply an open cavity with spaces between the coils of the heater element 23 filled with interface material. The upper plate may likewise contain a cavity to accept the TPG diffusion layer 17. The TPG diffusion layer 17 may have a sputtered coating of molybdenum or other high-temperature sputter material that bonds to metal (where "high-temperature" refers to 500° C. or greater). Metals other than molybdenum that could be sputtered onto the TPG diffusion layer include nickel alloys, titanium, magnesium, tungsten, copper, aluminum, and combinations or alloys of the same.

Interface material is any material added to fill voids between the two plates 13 and 15 and heater element 23, such as a potting compound, as well as material to bond the two plates 13 and 15, such as a braze material or cement. In one embodiment, a braze material directly contacts the heater element 23 in the lower plate 15 to the coated TPG diffusion layer 17 in the upper plate 13. A nickel braze clad, such as Nickel 4777 (82Ni-7Cr-4Si-3Fe-3B) foil, may be provided between the coated TPG diffusion layer 17 and each of the plates 13 and 15, and the entire assembly then vacuum furnace brazed.

For the heater element's electrical isolation (using MgO insulation), electrical resistance between the internal heater wire and its insulating sheath has a tendency to break down significantly starting around 450° C. To overcome this problem, we have increased the sheath diameter from a 0.125" (3.2 mm) diameter element to a 0.188" (4.8 mm) diameter element in order to increase the dielectric distance and are able to achieve 600° C. without bad leakage current. Additionally, higher temperature dielectrics, namely boron nitride, could replace the MgO as the heater element's insulating sheath. The isolation material, while providing electrical resistance, should also have good thermal conductivity. Boron nitride has this combination of properties.

To determine the effect of the hyper-conductive diffusion layer 17 in heater plate 11, we used an existing design for the lower plate 15 and heater element 23, and made an upper plate 13 with the added diffusion layer 17 of TPG. Both heater plates 13 and 15 were made of stainless steel. The diffusion layer 17 was fused into a cavity between the heater element 23 and the upper plate 15. The critical surfaces on the outside of the upper plate for both the embodiment of the present invention so made and a standard heater plate of the prior art without the TPG heater layer 17 were painted with a high temperature flat black paint to insure consistent emissivity for infrared evaluation. Both plates were placed in a chamber on small ceramic standoffs for side-by-side thermal imaging. Thermal images were taken in both atmosphere and vacuum. IR analysis settings were 21° C. ambient, 0.95 emissivity, lens factor 1, 16" focus, 6×4.5 cm field of view, high temperature range of 265.82° C., and low temperature range of 26.69° C. for a test at nominal heater temperature 250° C. The results for the heater 11 of the present invention with TPG diffusion layer 17 were a maximum temperature of 244.88° C., a minimum temperature of 230.02° C., an average temperature of 240.50° C., and a standard deviation of 4.19° C. The results for the standard heater plate without the TPG diffusion layer were a maximum temperature of 260.01° C., a minimum temperature of 225.97° C., an average temperature of 249.87° C., and a standard deviation of 9.69° C. The temperature uniformity across the plate improved from ±17° C. for the standard plate to ±7° C. by adding the diffusion layer, a 59% reduction in ΔT.

What is claimed is:

1. A uniform heater, comprising:

first and second metal plates, one of the plates providing a critical heating surface;

a heater element contained within the first metal plate; and a core formed of a thermally-annealed pyrolytic graphite diffuser sandwiched between the heater element and the second metal plate with the diffuser in direct contact with the heater element;

braze alloy sheets between the thermal diffuser and the respective plates;

wherein the diffuser and metal plates are vacuum thermal brazed together; and wherein the metal coating encapsulating the diffuser is a sputtered metal coating selected to aid in brazing the diffuser to the metal plates.

2. A heater as in claim 1, wherein the sputtered metal coating is selected from any one or more of molybdenum, nickel alloys, titanium, copper, aluminum, and combinations and alloys thereof.

3. A heater as in claim 1, wherein the metal plates are composed of any one or more of copper, aluminum, molybdenum, tungsten, nickel alloys, stainless steel, and titanium.

4. A heater as in claim 1, wherein the heater element has an electrically insulating material with an insulation distance sufficient to ensure minimal leakage current at temperatures in excess of 450° C.

5. A heater as in claim 4, wherein the insulation is composed of MgO with a heater diameter of at least 0.188" (4.8mm).

6. A heater as in claim 4, wherein the insulation is composed boron nitride.

7. A uniform heater, comprising:

upper and lower metal plates, the upper one of the plates providing a critical heating surface;

a heater element contained in a cavity within the lower metal plate, the heater element being electrically isolated from the lower metal plate by a thermally conducting electrically insulating material; and a heat spreader core formed of a thermally-annealed pyrolytic graphite (TPG) diffuser encapsulated with a metal coating and contained within a cavity of the upper metal plate and bonded with a braze material to the upper metal plate, the heat spreader core being in direct contact with the heater element.

8. A heater as in claim 7, wherein the insulation is composed boron nitride.

9. A heater as in claim 7, wherein the insulation is composed of MgO with a heater diameter of at least 0.188" (4.8mm).

10. A heater as in claim 7, wherein the metal plates are composed of any one or more of copper, aluminum, molybdenum, tungsten, nickel alloys, stainless steel, and titanium.

11. A heater as in claim 7, wherein the diffuser is vacuum thermal brazed to the upper metal plate.

12. A heater as in claim 11, wherein the metal coating encapsulating the diffuser is a molybdenum coating and a braze alloy sheet is present between the diffuser and the upper metal plate.

13. A method of making a uniform heater, comprising:

sandwiching a first metal plate, a heater element;

a thermally-annealed pyrolytic graphite diffuser encapsulated with a metal coating, a braze sheet, and a second metal plate; and vacuum thermally brazing sandwiched elements, with the diffuser in direct contact with the heater element.

14. The method as in claim 13, wherein the sheath is a dielectric selected from either of magnesium oxide (MgO) or boron nitride.

15. The method as in claim 13, wherein the heater element is provided with a thermally conducting electrically insulating material to a heater diameter of at least 0.188" (4.8mm).

16. The method as in claim 13, wherein the bonding is performed by thermal brazing the respective elements together using a braze material selected for the metal plate material.

17. The method as in claim 13, wherein the metal plates are composed of any one or more of copper, aluminum, molybdenum, tungsten, nickel alloys, stainless steel, titanium.

18. The method as in claim 13, wherein the first metal plate has a cavity to accept the heater element therein.

19. The method as in claim 18, wherein the cavity in the first metal plate is a spiral cavity to accept spiral coils of the heater element.

20. The method as in claim 13, wherein an interface is provided to fill spaces between coils of the heater element.

21. The method as in claim 13, wherein the second metal plate has a cavity to accept the diffuser therein.

22. The method as in claim 13, wherein the diffuser is sputter coated with a high-temperature sputter material.

23. The method as in claim 22, wherein the sputter material is selected from any one or more of molybdenum, nickel alloys, titanium, copper, aluminum, and combinations and alloys thereof.

24. The method as in claim 16, wherein braze material between the diffuser and the second metal plate comprises a nickel braze alloy sheet.

* * * * *